US007669577B2

(12) United States Patent
Rosso

(10) Patent No.: US 7,669,577 B2
(45) Date of Patent: Mar. 2, 2010

(54) GEROTOR AND METHOD OF ASSEMBLING THE SAME

(75) Inventor: Paul A. Rosso, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 196 days.

(21) Appl. No.: 12/027,465

(22) Filed: Feb. 7, 2008

(65) Prior Publication Data

US 2009/0202377 A1 Aug. 13, 2009

(51) Int. Cl.

| | |
|---|---|
| ***F02B 53/00*** | (2006.01) |
| ***B23P 15/00*** | (2006.01) |
| ***F04C 2/10*** | (2006.01) |
| ***F04C 15/00*** | (2006.01) |

(52) U.S. Cl. ..... 123/200; 29/888.02; 29/888.023; 418/1; 418/61.3

(58) Field of Classification Search ..... 123/200; 418/1, 61.3; 29/888.02, 888.023, 893.2, 29/434, 456, 469

See application file for complete search history.

(56) References Cited

U.S. PATENT DOCUMENTS

| | | | |
|---|---|---|---|
| 1,169,513 | A | 1/1916 | Royle, Jr. |
| 4,171,939 | A | 10/1979 | Harwath |
| 4,361,196 | A | 11/1982 | Hoyle, Jr. |
| 5,215,165 | A | 6/1993 | Torii |
| 5,662,462 | A | 9/1997 | Paley et al. |
| 6,024,550 | A | 2/2000 | Miyazaki et al. |
| 6,126,424 | A | 10/2000 | Wenker et al. |
| 6,264,451 | B1 | 7/2001 | Murayama et al. |
| 6,270,169 | B1 | 8/2001 | Harada et al. |
| 6,347,843 | B1 | 2/2002 | Murayama et al. |
| 6,405,716 | B2 | 6/2002 | Braun et al. |
| 6,408,716 | B1 | 6/2002 | Phelon |
| 6,474,752 | B2 | 11/2002 | Harada et al. |
| 6,592,191 | B2 | 7/2003 | Murayama et al. |
| 6,619,761 | B2 | 9/2003 | Murayama et al. |
| 6,643,927 | B2 | 11/2003 | Murayama et al. |
| 7,435,066 | B2 | 10/2008 | Enzaka et al. |
| 2006/0216187 | A1 | 9/2006 | Enzaka et al. |

FOREIGN PATENT DOCUMENTS

| | | | |
|---|---|---|---|
| DE | 9304600 | U1 * | 7/1994 |
| DE | 9304600.6 | U1 | 9/1994 |
| DE | 19847082 | A1 | 4/1999 |

(Continued)

*Primary Examiner*—Thomas E Denion
*Assistant Examiner*—Mary A Davis
(74) *Attorney, Agent, or Firm*—Whyte Hirschboeck Dudek SC

(57) ABSTRACT

A gerotor and methods for assembling the gerotor are disclosed. The gerotor includes a pump housing having a channel and a rotor positioning cavity, a pump shaft, an inner rotor, and an outer rotor. The pump shaft has central pump shaft axis and the inner rotor has a central inner rotor axis. The methods include: inserting the pump shaft through the channel; sliding the inner rotor onto the pump shaft at an oblique angle such that the central inner rotor axis is at least partially angularly offset from the central pump shaft axis; rotating the inner rotor to substantially align the central inner rotor axis and the central pump shaft axis and to engage the pump shaft with the inner rotor; and positioning the outer rotor around the inner rotor to maintain substantial alignment of the inner rotor with the pump housing and/or the pump shaft.

22 Claims, 7 Drawing Sheets

FOREIGN PATENT DOCUMENTS

| | | | | |
|---|---|---|---|---|
| DE | 19918376 | A1 | | 11/1999 |
| DE | 19918390 | A1 | | 11/1999 |
| EP | 1710437 | A2 | | 10/2006 |
| GB | 569359 | | | 5/1945 |
| GB | 2017865 | A | | 3/1979 |
| JP | 57159983 | | | 10/1982 |
| JP | 5991405 | | | 6/1984 |
| JP | 62102886 | U | | 6/1987 |
| JP | 62191925 | U | | 12/1987 |
| JP | 02221692 | | | 9/1990 |
| JP | 552284 | | | 7/1993 |
| JP | 10077973 | | | 3/1998 |
| JP | 10184560 | | | 7/1998 |
| JP | 11132160 | | | 5/1999 |
| JP | 11132160 | A | * | 5/1999 |
| JP | 2003176790 | | | 7/2001 |
| JP | 2003035278 | | | 2/2003 |
| JP | 2004162732 | | | 6/2004 |
| JP | 2007064140 | A | * | 3/2007 |
| WO | 9818185 | | | 4/1998 |
| WO | 2005019650 | A1 | | 3/2005 |
| WO | 2005066502 | A1 | | 7/2005 |

* cited by examiner

GEROTOR AND METHOD OF ASSEMBLING THE SAME

CROSS-REFERENCE TO RELATED APPLICATIONS

STATEMENT REGARDING FEDERALLY SPONSORED RESEARCH OR DEVELOPMENT

FIELD OF THE INVENTION

The present invention relates generally to internal combustion engines and, more particularly, to gerotors for use in internal combustion engines and methods of assembling such gerotors.

BACKGROUND OF THE INVENTION

A gerotor is a widely used pumping mechanism that utilizes a pair of meshed gears in a chamber to create a pumping action to pump various liquids (e.g., oil). One of the gears is an inner gear with outer gear teeth, and the other gear is an outer gear with inner gear teeth. The inner gear has one less gear tooth than the outer gear. The offset created by the feature(s) of the inner gear in relation to the outer gear establishes a cavity between the gears. When the inner gear is rotated, the cavity between the teeth opens through half of a revolution and closes through the other half. The opening and closing of the cavity facilitates a pumping action whereby liquid may be drawn into the cavity through a channel during the opening phase and liquid is discharged from the cavity through another channel during the closing phase.

Previous solutions of assembling gerotors included permanently securing the pump shaft to an inner gear, for example, by welding the two parts together. While welding methods may provide a secure union, they suffer from several disadvantages. Welding the pump shaft and inner gear together is a fairly expensive and time-consuming assembly process. Further, welding can result in varying quality of the connection and may increase the opportunity for manufacturing defects. Additionally, welding requires extra materials and machinery.

Further, several less permanent methods have been used as well, such as coupling a pump shaft notch and an inner gear notch by inserting a single key that engages both notches. Using a separate key also has several disadvantages, for example, the key is a separate loose part that only provides limited rotational securing. Rotational securing is provided only while the key is maintained in the pump shaft and inner gear notches, and while the pump shaft is not subject to substantial axial movement with respect to the inner gear. Therefore, a separate additional means for securing the pump shaft axially to the inner gear would be required. Additionally, these prior methods of assembly result in a gerotor that is difficult to assemble, to disassemble and to repair.

For at least these reasons, therefore, it would be advantageous to provide a new gerotor assembly and methods for assembling a gerotor. Further, it would be desirable if, in at least some embodiments, such gerotors and assembly methods could be implemented at a reduced cost and required less time to implement relative to prior solutions. Additionally, it would be advantageous to provide a new gerotor that can, in at least some embodiments, be assembled with a lower opportunity for manufacturing defects and with less individual parts. Further, it would be advantageous to provide a new gerotor that allows, in at least some embodiments, for efficient and predictable disassembly of the pump shaft and inner rotor.

BRIEF SUMMARY OF THE INVENTION

In one aspect, the present invention relates to a method for assembling a gerotor. The gerotor includes a pump housing with a channel extending at least substantially through it and a rotor positioning cavity extending from the channel, a pump shaft having a central pump shaft axis, an outer rotor, and an inner rotor having a central inner rotor axis. The method of assembly includes inserting the pump shaft through the channel in the pump housing and at least partially through the rotor positioning cavity. The method still further includes sliding the inner rotor onto the pump shaft at an oblique angle such that the central inner rotor axis is at least partially angularly offset from the central pump shaft axis. The method also includes rotating the inner rotor such that the central inner rotor axis is substantially aligned with the central pump shaft axis to engage the pump shaft with the inner rotor. Still further, the method includes positioning the outer rotor around the inner rotor to maintain substantial alignment of the inner rotor with respect to at least one of the pump shaft and the pump housing.

In another aspect, the gerotor as an assembly is disclosed. The gerotor assembly includes a pump housing with a channel that extends at least substantially through it and a rotor positioning cavity that extends from the channel. The assembly further has a pump shaft with a central pump shaft axis and at least one pump shaft notch at an insertion end portion, where the insertion end portion is inserted through the channel and at least partially into the rotor positioning cavity. Also, the assembly includes an inner rotor, having a central inner rotor axis, for insertion onto the insertion end portion of the pump shaft at an oblique angle such that a central inner rotor axis is at least partially angularly offset from the central pump shaft axis. Additionally, the inner rotor has at least one protrusion extending radially inward into an inner mating cavity. The protrusion is generally complementary to the pump shaft notch, whereby the inner rotor is rotated such that the central inner rotor axis is substantially aligned with the central pump shaft axis. When the inner rotor is rotated, the at least one protrusion is engaged with the at least one pump shaft notch, substantially securing the pump shaft with respect to at least one of the inner rotor and the pump housing. The assembly further includes an outer rotor, where the outer rotor is engaged with the inner rotor such that the interface substantially maintains alignment of the central inner rotor axis and the central pump shaft axis, thereby interlocking the pump shaft with the inner rotor and securing the pump shaft to at least one of the inner rotor and the pump housing.

And in yet another exemplary aspect, the present invention relates to an internal combustion engine having a crankcase and a gerotor assembly connected at least indirectly to the crankcase. The gerotor assembly includes a pump housing that is connected to, or at least partially integrally formed with, the crankcase. The pump housing includes a channel that extends at least substantially through it and a rotor positioning cavity that extends from the channel. The assembly further includes a pump shaft having a central pump shaft axis, where the pump shaft is insertable through the channel and at least partially into the rotor positioning cavity. The assembly additionally includes an inner rotor having a central inner rotor axis, where the inner rotor is insertable onto the pump shaft at an oblique angle such that, during insertion, the central inner rotor axis is at least partially angularly offset from the central pump shaft axis. Once the inner rotor is inserted onto the pump shaft it is positioned such that the central inner rotor axis is substantially aligned with the central pump shaft axis and the pump shaft is engaged to the inner rotor. Further, the assembly includes an outer rotor where the outer rotor is engaged with the inner rotor such that the interface maintains substantial alignment of the inner rotor with respect to at least one of the pump housing and the pump shaft.

Various other aspects, objects, features and embodiments are contemplated and considered within the scope of the invention.

BRIEF DESCRIPTION OF THE DRAWINGS

Embodiments of the invention are disclosed with reference to the accompanying drawings and these embodiments are provided for illustrative purposes only. The invention is not limited in its application to the details of construction or the arrangement of the components illustrated in the drawings. Rather, the invention is capable of other embodiments and/or of being practiced or carried out in other various ways. The drawings illustrate a best mode presently contemplated for carrying out the invention. Like reference numerals are used to indicate like components.

In the drawings.

DETAILED DESCRIPTION OF THE PREFERRED EMBODIMENT

Figure 1:
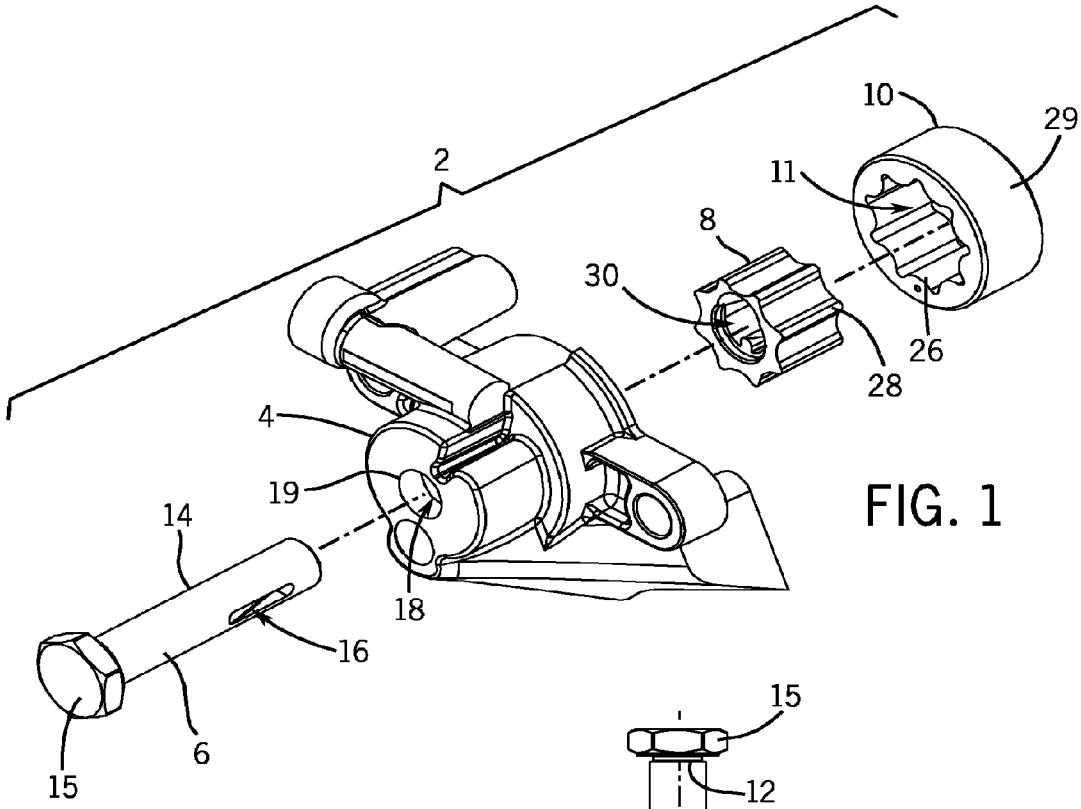
FIG. 1 is an exploded perspective view of a gerotor assembly in accordance with at least some embodiments of the present invention.

Referring to FIG. 1, a gerotor assembly 2 is shown having a pump housing 4, a pump shaft 6, an inner rotor 8, and an outer rotor 10, in accordance with one embodiment of the present invention. The gerotor assembly 2 has particular features that facilitate the introduction of the pump shaft 6 into a pump housing 4 such that it may be fittingly secured by the inner rotor 8.

Figure 2A:
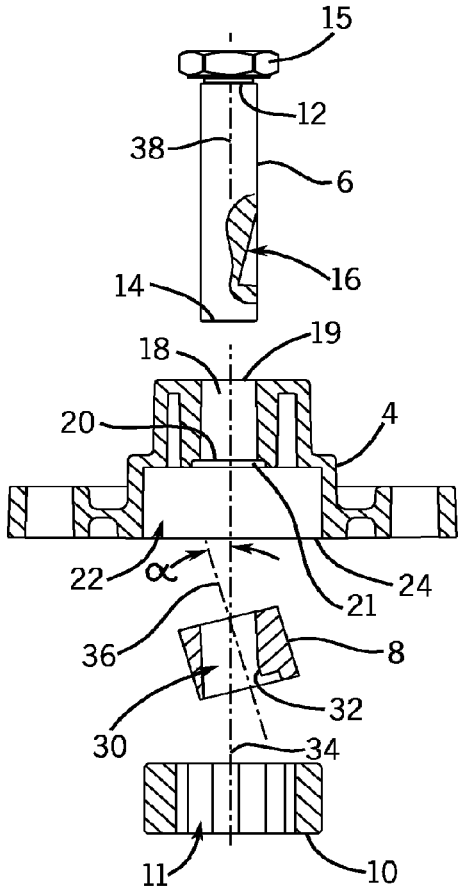
FIGS. 2A-2E are exploded cross-sectional side views showing a portion of the gerotor assembly of FIG. 1, and depicting assembly of the gerotor in accordance with at least some of the embodiments of the present invention.
Figure 2B:
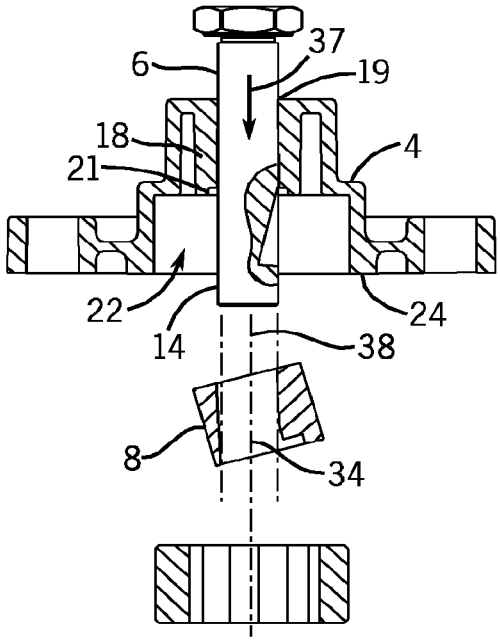

As shown in FIGS. 1 and 2A, the pump shaft 6 is cylindrical in shape and includes a drive end 12 (FIG. 2A) and an insertion end portion 14. Connected to the drive end 12 is a connection mechanism 15 (e.g., a nut, bolt, etc.) for connecting the pump shaft 6 to a drive mechanism, such as a gear of an engine, an exemplary embodiment of which is shown and described with respect to FIG. 7. The insertion end portion 14 of the pump shaft 6 has a pump shaft notch 16. The pump housing 4 is suitable for accepting the pump shaft 6 therein. More specifically, the pump housing 4 includes a cylindrical channel 18 having a channel top edge 19 and a channel bottom edge 20. Further, and in accordance with at least some embodiments, the pump housing 4 includes a circumferential rotational gap 21 situated adjacent to the channel bottom edge 20. Additionally, the pump housing 4 has a circumferential rotor positioning cavity 22 that extends from the rotational gap 21 to a pump housing bottom edge 24.

A rotational gap (also referred to as a "kidney gap", "dip" and the like), such as the rotational gap 21, is a common feature often found in gerotor pump mechanisms and serves, at least in part, to provide a clearance between an inner rotor and a rotor positioning cavity. Moreover, the rotational gap can, in at least some instances, be used to regulate flow properties (e.g., turbulence) of a gerotor pump mechanism. In general, the need for a rotational gap is based on several factors, including but not limited to, the required clearance tolerance between the inner rotor and the pump housing. In addition, the size and shape of the rotational gap can vary to convenience. Although shown in various embodiments of the invention disclosed herein, it is contemplated that the presence of any rotational gap is not necessarily required, or necessarily desired. When the rotational gap is omitted, the channel 18 would typically extend to the rotor positioning cavity 22.

Further, the outer rotor 10 has a circular profile and includes an outer rotor cavity 11 surrounded by a plurality of inner gear teeth 26 on an inside perimeter. The inner rotor 8 also is generally circular with outer gear teeth 28 along an outside perimeter, such that the outer gear teeth 28 can be meshingly engaged with the inner gear teeth 26.

Further, the outer rotor 10 has an outer rotor circumference 29 that is sized to fit closely inside the rotor positioning cavity 22. The inner rotor 8 also includes an inner mating cavity 30 and a rotor protrusion 32 that extends radially inward into the inner mating cavity 30, with the rotor protrusion 32 being generally complementary in shape and size to the pump shaft notch 16. The inner mating cavity 30 is substantially cylindrical and has a central inner mating cavity axis 34 that is obliquely offset from a central inner rotor axis 36. Stated another way, there is an oblique angle a between the central inner mating cavity axis 34 and the central inner rotor axis 36.

Figure 2C:
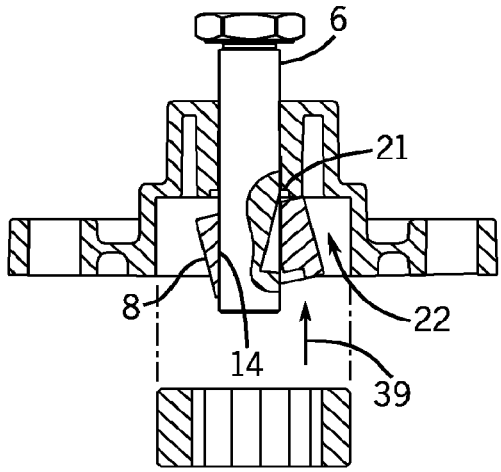
Figure 2D:
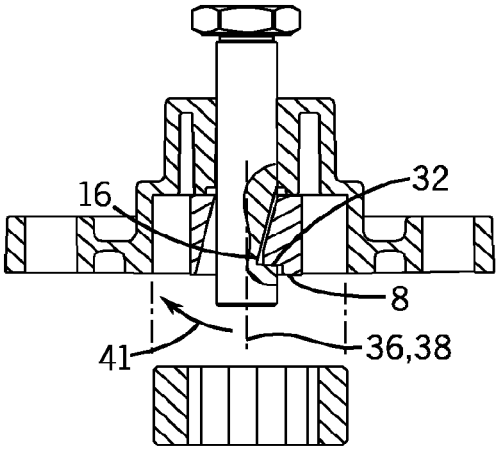

Turning to FIGS. 2B-2E, an exemplary manner of assembly of the gerotor assembly 2 is shown. More specifically, with reference to FIG. 2B, the insertion end portion 14 of the pump shaft 6 is inserted in an insertion direction 37 (which is shown to be downward), from the channel top edge 19 towards the pump housing bottom edge 24, extending through the channel 18, the rotational gap 21 and into, or at least substantially into, the rotor positioning cavity 22. The inner rotor 8 is situated such that the central inner mating cavity axis 34 is aligned with a central pump shaft axis 38. Referring to FIG. 2C, with the pump shaft 6 in place, the inner rotor 8 is slid, in a sliding direction 39 (which is shown to be upward), over the insertion end portion 14 of the pump shaft 6, and substantially inside the rotor positioning cavity 22. Thus, in accordance with at least some embodiments, including the embodiment illustrated, at least a portion of the inner rotor 8 is situated inside the rotational gap 21. Turning to FIG. 2D, the inner rotor 8 next is rotated in a rotation direction 41, such that the central inner rotor axis 36 is now aligned with the central pump shaft axis 38, and the rotor protrusion 32 generally complementarily engages the pump shaft notch 16.

Thus, in accordance with at least those embodiments employing a rotational gap, such as gap 21, at least a portion of the inner rotor 8 is rotated out of the rotational gap. As shown, the rotation direction 41 is about an axis that is perpendicular to or substantially perpendicular to the central pump shaft axis 38.

Figure 2E:
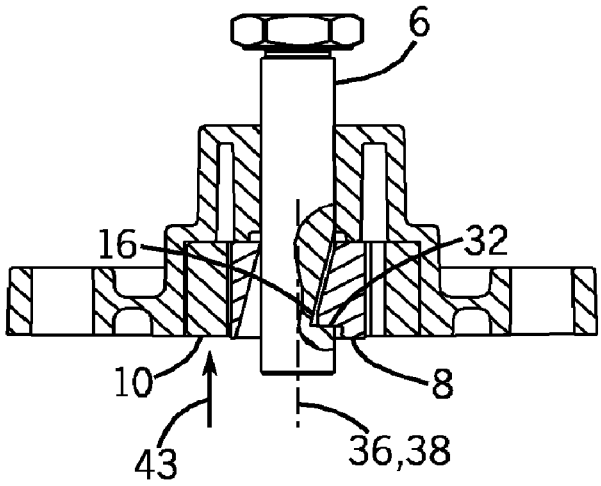

Further as shown in FIG. 2E, after rotation of the inner rotor 8, the outer rotor 10 is positioned over and around the inner rotor 8 in the positioning direction 43 (which is shown to be upward), thereby situating the outer rotor 10 inside, or substantially within, the rotor positioning cavity 22. The inner gear teeth 26 of the outer rotor 10 meshingly engage the outer gear teeth 28 of the inner rotor 8 (the teeth being shown more clearly in FIG. 1). With the outer rotor 10 situated over and around the inner rotor 8, the central inner rotor axis 36 of the inner rotor 8 is maintained in substantial alignment with the central pump shaft axis 38. Further, the inner rotor 8 and the pump shaft 6 are secured such that relative movement is precluded along a central inner rotor axis 36, and more specifically, the inner rotor 8 and the pump shaft 6 are secured via the rotor protrusion 32 engaging the pump shaft notch 16. Due to the interface between the protrusion 32 and notch 16, the inner rotor 8 and pump shaft 6 are secured to one another to prevent relative rotational movement there between. Moreover, this interface can also serve to prevent, or at least substantially reduce, axial movement of the inner rotor 8 relative to the pump shaft 6 along the central pump shaft axis 38. In this way, this interface between the notch 16 and protrusion 32 serve to allow for driving of the inner rotor 8 in a rotational fashion.

Figure 3A:
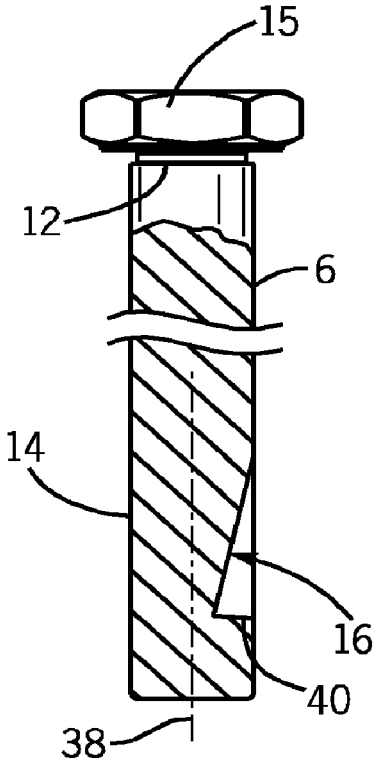
FIGS. 3A and 3B are cross-sectional views showing an inner rotor protrusion and a pump shaft notch of the inner rotor and pump shaft of FIGS. 1 and 2A-2E in accordance with at least some embodiments of the present invention.
Figure 3B:
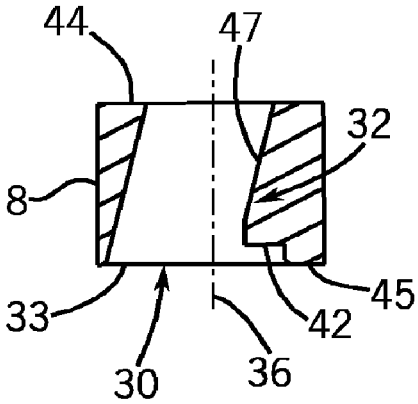

FIGS. 3A and 3B, respectively, are additional cross-sectional views showing the pump shaft notch 16 of the insertion end portion 14 of the pump shaft 6 and the rotor protrusion 32 of the inner rotor 8, respectively. As shown, the pump shaft notch 16 extends in a longitudinal direction along the insertion end portion 14 of the pump shaft 6. The notch 16 in particular increases radially in depth as it extends away from the drive end 12 along the pump shaft 6, and terminates at a notch edge 40 that extends substantially perpendicularly with respect to the central pump shaft axis 38. The rotor protrusion 32 is generally complementary in size and shape to the pump shaft notch 16, and includes a lateral extension 47 that increasingly extends radially inward into the inner mating cavity 30 from at or near an inner rotor top end 44 towards an inner rotor bottom end 45. The rotor protrusion 32 terminates with a protrusion edge 42 that extends substantially perpendicularly with respect to the central inner rotor axis 36. As discussed above, during assembly the rotor protrusion 32 engages the pump shaft notch 16 thereby rotationally securing the pump shaft 6 to the inner rotor 8. The engagement of the protrusion edge 42 and the notch edge 40 axially secures the pump shaft 6 to the inner rotor 8 with respect to the central inner rotor axis 36.

Notwithstanding the above-described embodiments, various other shapes, sizes, configurations and numbers of gerotor assembly features (e.g., pump shaft notches, rotor protrusions, etc.) can be used for securing (e.g., lateral, axial and/or rotational securing) the appropriate gerotor components, for example, the pump shaft with respect to at least one of the inner rotor and the pump housing. Embodiments having such variations are contemplated and considered within the scope of the present invention.

Figure 4:
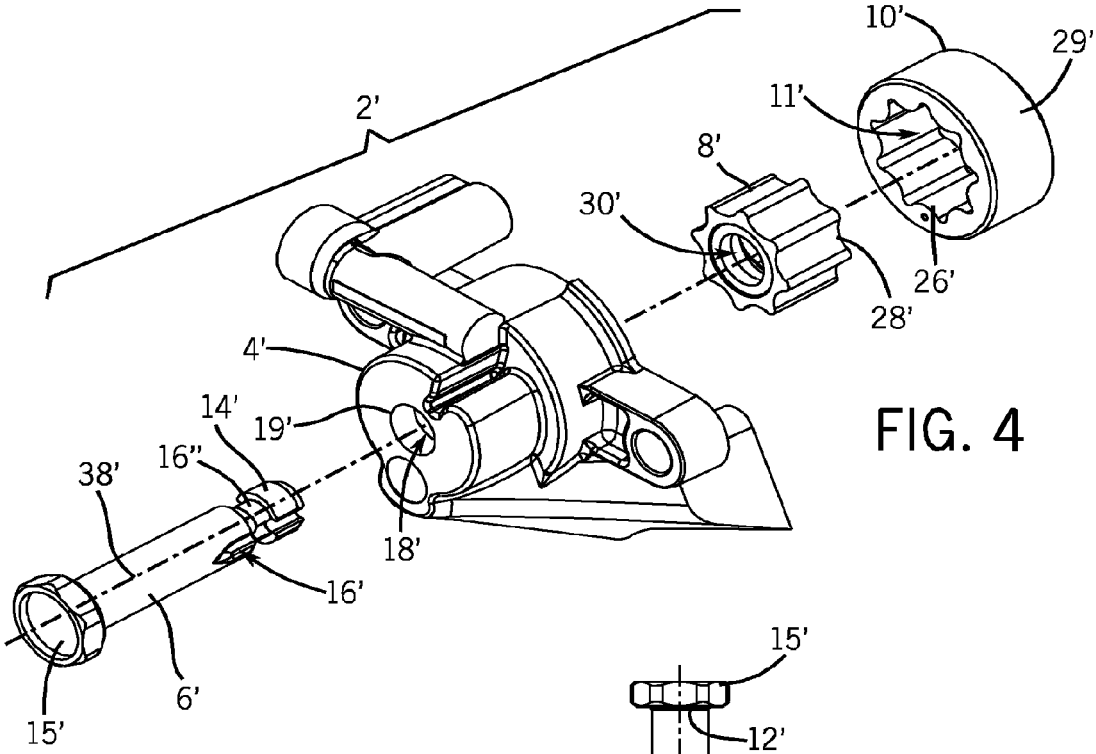
FIG. 4 is an exploded perspective view of another gerotor assembly in accordance with at least some embodiments of the present invention.

For example, referring to FIG. 4, a gerotor assembly 2' is shown having a pump housing 4', a pump shaft 6', an inner rotor 8', and an outer rotor 10', in accordance with one additional embodiment of the present invention. The gerotor assembly 2' has particular features that facilitate the introduction of the pump shaft 6' into a pump housing 4' such that it may be fittingly secured by the inner rotor 8'.

Figure 5A:
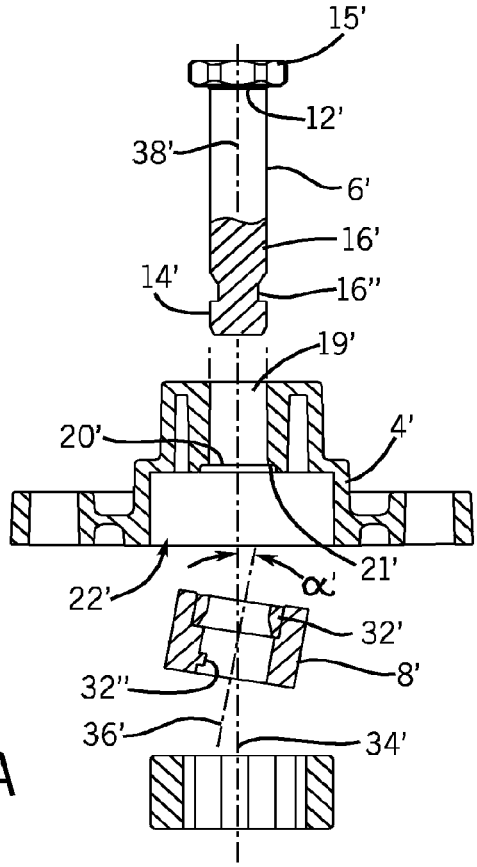
FIGS. 5A-5E are exploded cross-sectional side views showing a portion of the gerotor assembly of FIG. 4, and depicting assembly of the gerotor in accordance with at least some of the embodiments of the present invention.
Figure 5B:
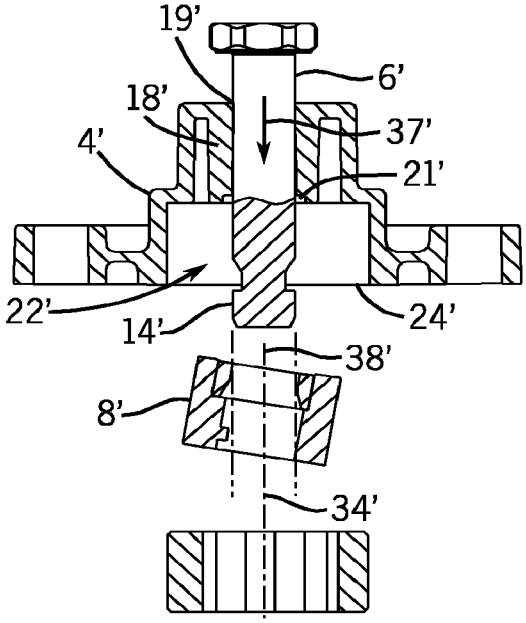

As shown in FIGS. 4 and 5A, the pump shaft 6' is cylindrical in shape and includes a drive end 12' (FIG. 5A) and an insertion end portion 14'. Connected to the drive end 12' is a connection mechanism 15' (e.g., a nut, bolt, etc.) for connecting the pump shaft 6' to a drive mechanism, such as a gear of an engine (see FIG. 7 and associated description below). The insertion end portion 14' of the pump shaft 6' includes a first pump shaft notch 16' and a second pump shaft notch 16". The first pump shaft notch 16' extends in a longitudinal direction along the insertion end portion 14' of the pump shaft 6'. The second pump shaft notch 16" extends in an annular fashion around the pump shaft 6', creating an area of the pump shaft 6' having a reduced diameter. Additionally, the first pump shaft notch 16' is intersected by the second pump shaft notch 16". The pump housing 4' is suitable for accepting the pump shaft 6' therein. More specifically, the pump housing 4' includes a cylindrical channel 18' having a channel top edge 19' and a channel bottom edge 20'. Further the pump housing 4' in at least one embodiment includes a circumferential rotational gap 21' situated adjacent to the channel bottom edge 20'. Additionally, the pump housing 4' has a circumferential rotor position cavity 22' that extends from the rotational gap 21' to a pump housing bottom edge 24'. The outer rotor 10' has a circular profile and includes an outer rotor cavity 11' surrounded by a plurality of inner gear teeth 26' on an inside perimeter. The inner rotor 8' also is generally circular with outer gear teeth 28' along an outside perimeter, such that the outer gear teeth 28' can be meshingly engaged with the inner gear teeth 26'.

Further, the outer rotor 10' has an outer rotor circumference 29 that is sized to fit closely inside the rotor positioning cavity 22'. The inner rotor 8' also includes an inner mating cavity 30', and a first and second rotor protrusion 32' and 32" respectively, that extend radially inward into the inner mating cavity 30'. The first rotor protrusion 32' is generally complementary in shape and size to the first pump shaft notch 16', and the second rotor protrusion 32" is generally complementary in shape and size to the second pump shaft notch 16". The inner mating cavity 30' is substantially cylindrical and has a central inner mating cavity axis 34' that is angularly offset from a central inner rotor axis 36'. Stated another way, there is an oblique angle $\alpha'$ between the central inner mating cavity axis 34' and the central inner rotor axis 36'.

Figure 5C:
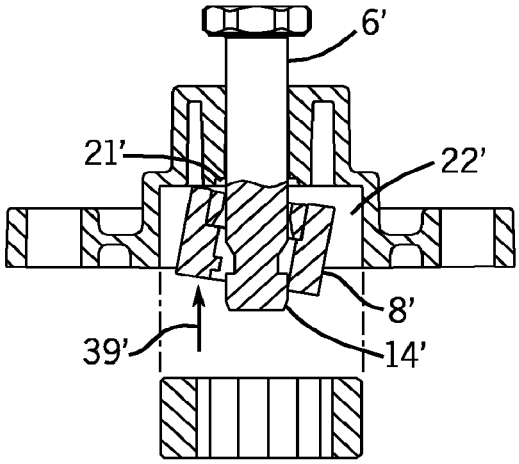
Figure 5D:
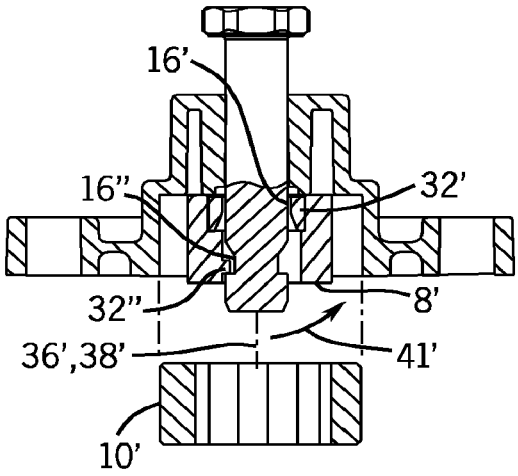

Turning to FIGS. 5B-5E, another exemplary manner of assembly of the gerotor assembly 2' is shown. More specifically, with reference to FIG. 5B, the insertion end portion 14' of the pump shaft 6' is inserted in an insertion direction 37' (which is shown to be downward), from the channel top edge 19' towards the pump housing bottom edge 24', extending through the channel 18', the rotational gap 21' and into, or at least substantially into, the rotor positioning cavity 22'. Thus, in accordance with at least some embodiments (including the embodiment illustrated) at least a portion of the inner rotor 8' is situated such that the central inner mating cavity axis 34' is aligned with a central pump shaft axis 38'. Referring to FIG. 5C, with the pump shaft 6' in place, the inner rotor 8' is slid, in a sliding direction 39' (which is shown to be upward), over the insertion end portion 14' of the pump shaft 6', and substantially inside the rotor positioning cavity 22', such that at least a portion of the inner rotor 8' is situated inside the rotational gap 21'. Turning to FIG. 5D, the inner rotor 8' next is rotated in a rotation direction 41', such that the central inner rotor axis 36' is now aligned with the central pump shaft axis 38', and the first rotor protrusion 32' engages the first pump shaft notch 16', and the second rotor protrusion 32" engages the second pump shaft notch 16". Thus, in accordance with at least those embodiments employing a rotational gap, such as gap 21', at least a portion of the inner rotor 8' is rotated out of the rotational gap. As shown, the rotation direction 41' is about an axis that is perpendicular to or substantially perpendicular to the central pump shaft axis 38'.

Figure 5E:
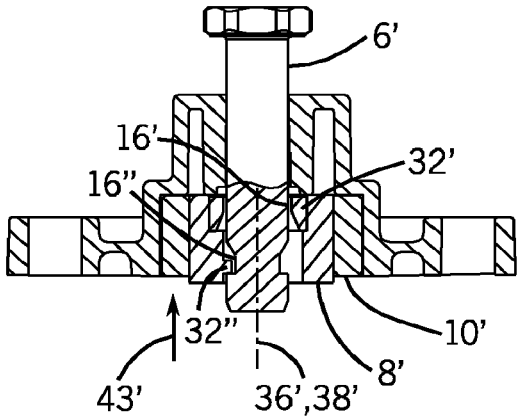

Further as shown in FIG. 5E, after rotation of the inner rotor 8', the outer rotor 10' is positioned over and around the inner rotor 8' in the positioning direction 43' (which is shown to be upward), thereby situating the outer rotor 10' inside, or substantially within, the rotor positioning cavity 22'. The inner gear teeth 26' of the outer rotor 10' meshingly engage the outer gear teeth 28' of the inner rotor 8' (the teeth being shown more clearly in FIG. 4). With the outer rotor 10' situated over and around the inner rotor 8', the central inner rotor axis 36' of the inner rotor 8' is maintained in substantial alignment with the central pump shaft axis 38'. Further, the inner rotor 8' and the pump shaft 6' are secured, and more specifically, the inner rotor 8' and the pump shaft 6' are secured via the first and second rotor protrusions 32', 32" engaging the first and second pump shaft notches 16', 16", respectively. The engagement of the first rotor protrusion 32' and the first pump shaft notch 16' provide a rotational securing of the pump shaft 6' to the inner rotor 8', and the engagement of the second rotor protrusion 32" and the second pump shaft notch 16" provide an axial securing of the pump shaft 6' to the inner rotor 8' with respect to the central inner rotor axis 36. Thereby, due to the interface between the protrusions 32' and 32" and notches 16' and 16", the inner rotor 8' and pump shaft 6' are secured to one another to prevent relative rotational movement there between. Here again, this interface can also serve to prevent, or at least substantially reduce, axial movement of the inner rotor 8' relative to the pump shaft 6' along the central pump shaft axis 38'. In this way, this interface between the notch 16' and protrusion 32' serve to allow for driving of the inner rotor 8' in a rotational fashion.

Additionally, although depicted with relative sizes and shapes, various materials and sizes of the aforementioned parts may be used to accomplish the assembly as described. Further, as is customary for gerotor pumps, the pump shaft drive end 12, 12' is engaged by a drive source such as a gear or pulley for driving the pump shaft 6, 6'.

Figure 6:
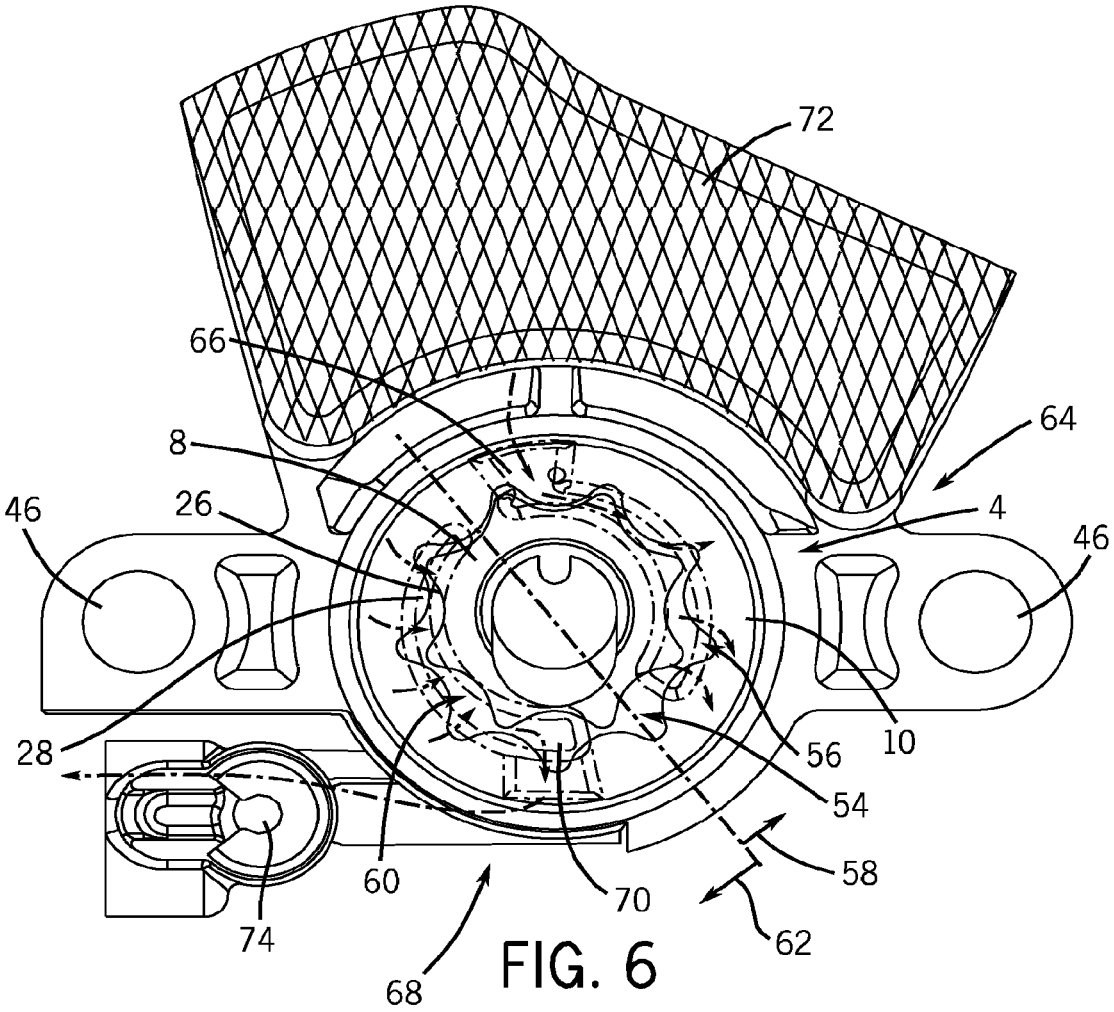
FIG. 6 is a bottom view of an assembled gerotor assembly, such as those of FIGS. 1-5E, in accordance with at least some embodiments of the present invention.

FIG. 6 is a bottom view of the assembled gerotor assembly 2 of FIG. 1, albeit the assembled gerotor assembly 2' of FIG. 4 would also look substantially the same. As depicted in FIG. 6 and as is customary for gerotor pumps, when the outer rotor 10 is positioned about the inner rotor 8 in the pump housing 4, a gear cavity 54 is created between the inner gear teeth 26 and the outer gear teeth 28 comprising a plurality of intake actuating chambers 56 on a pump intake side 58 for intaking liquid into the gear cavity 54, and a plurality of discharge actuating chambers 60 on a pump discharge side 62 for discharging liquid from the gear cavity 54. The pump housing 4 further includes a housing intake portion 64 that includes intake channels 66 for intaking liquid into the pump housing 4 and to the gear cavity 54, and a housing discharge portion 68 that includes discharge channels 70 for discharging liquid out of the pump housing 4 from the gear cavity 54.

Given the coupling between the pump shaft 6 and the inner rotor 8, rotation of the pump shaft 6 results in rotation of the inner and outer rotors 8 and 10. Consequently, the intake actuating chambers 56 in the gear cavity 54 create a suction pressure on the pump intake side 58 thereby pulling liquid in through the housing intake portion 64 and into the gear cavity 54. The liquid is then moved to the pump discharge side 62 where the discharge actuating chambers 60 create a discharge pressure that pushes the liquid out of the gear cavity 54 through the housing discharge portion 68. Also as shown, the housing intake portion 64 can include a screened intake port 72 and the housing discharge portion 68 can include a fitting of sorts or a port interface 74 to directly port the discharged liquid into a portion of the engine 75.

Figure 7:
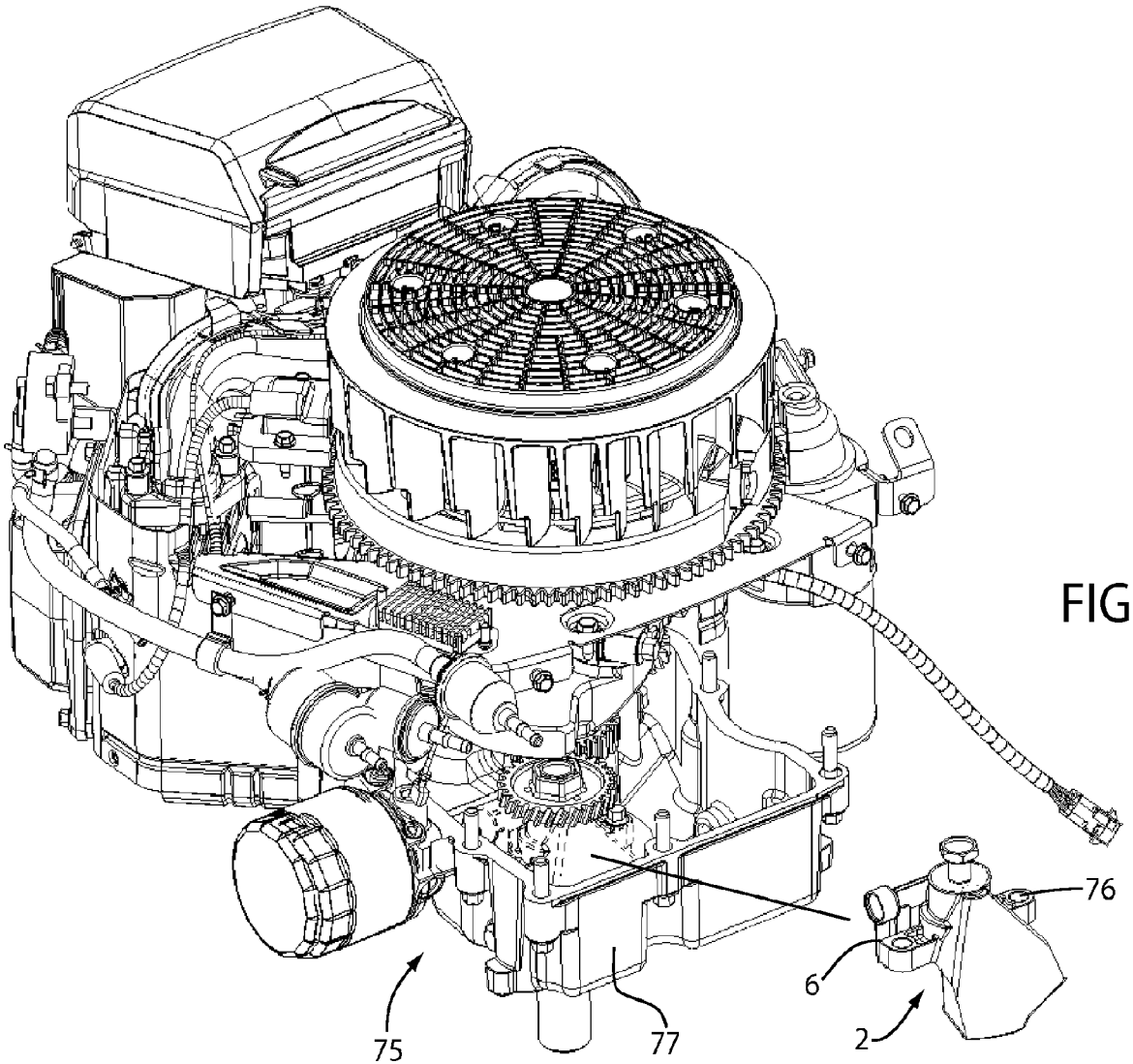
FIG. 7 is a perspective view of an exemplary internal combustion engine having a gerotor assembly, such as those of FIGS. 1-6, in accordance with at least some embodiments of the present invention.

FIG. 7 is a perspective partially-exploded view of an exemplary internal combustion engine 75 with an installed gerotor assembly (e.g., the assembly 2) in accordance with at least some further embodiments of the present invention. As shown, the gerotor assembly 2 is secured at least indirectly to a crankcase 77 of an internal combustion engine 75 using one or more mounting points 46. Alternatively, and in at least some embodiments the pump housing 4 is formed integrally with the crankcase. Additionally, the pump housing may be of unitary construction or may be assembled from multiple parts, with at least a portion of the pump housing being integral with the crankcase. It should be understood that various internal combustion engines are contemplated for use. One example is the Courage-Twin engine, as manufactured by The Kohler Company of Kohler, Wis.

In accordance with various aspects of the present invention, methods for assembling a gerotor are disclosed herein. In at least some embodiments, a method for assembling a gerotor comprises providing a pump housing with a channel extending at least substantially through the housing and a rotor positioning cavity extending from the channel, a pump shaft having a central pump shaft axis, an outer rotor, and an inner rotor having a central inner rotor axis. The method further includes inserting the pump shaft through the channel in the pump housing and at least partially through the rotor positioning cavity. The method still further includes sliding the inner rotor onto the pump shaft at an oblique angle such that the central inner rotor axis is at least partially angularly offset from the central pump shaft axis. The method also includes rotating the inner rotor such that the central inner rotor axis is substantially aligned with the central pump shaft axis to engage the pump shaft with the inner rotor. Still further, the method includes positioning the outer rotor around the inner rotor to maintain substantial alignment of the inner rotor with respect to at least one of the pump shaft and the pump housing.

In at least some embodiments of the present invention, the pump shaft can have an insertion end portion with a notch and the method can further include inserting the insertion end portion into the pump housing to position the notch at least partially inside the rotor positioning cavity. Still further, the method can include sliding the inner rotor onto the insertion end portion. And still further, the inner rotor can include at least one protrusion extending radially inward into an inner mating cavity with the protrusion being generally complementary to the notch, and the method can include rotating the inner rotor further such that the at least one protrusion engages the at least one pump shaft notch.

Further, in yet other embodiments of the present invention, rotating the inner rotor can further include complementarily engaging a lateral extension of the protrusion with the notch in a longitudinal direction with respect to the pump shaft, such that the engagement substantially secures the pump shaft rotationally with respect to the inner rotor. In some embodiments, rotating the inner rotor can further include complementarily engaging a notch edge of the pump shaft notch with a protrusion edge of the protrusion such that the engagement substantially secures the pump shaft axially to the inner rotor with respect to the central inner rotor axis.

In still other embodiments of the present invention, rotating the inner rotor can further include engaging the notch and the protrusion longitudinally with respect to the pump shaft, thereby substantially securing the pump shaft at least one of rotationally and axially with respect to the inner rotor. In other embodiments, rotating the inner rotor can further include complementarily engaging a second notch on the pump shaft with a second protrusion extending radially inward into the inner mating cavity of the inner rotor, and in some other embodiments, engaging the second protrusion and the second notch secures the pump shaft at least partially in an axial direction with respect to the inner rotor.

Further still, in accordance with other embodiments, the inner rotor has a plurality of outer gear teeth and the outer rotor has a plurality of inner gear teeth and the positioning can include meshingly engaging the outer gear teeth and the inner gear teeth. And still further, the positioning of the outer rotor with respect to the inner rotor can provides for a gear cavity between the inner gear teeth and the outer gear teeth, the gear cavity comprising a plurality of intake actuating chambers on an intake side for intaking liquid into the gear cavity and a plurality of discharge actuating chambers on the discharge side for discharging liquid from the gear cavity. Finally, in at least some embodiments, sliding the inner rotor can further include situating at least a portion of the inner rotor inside a rotational gap and rotating can further include rotating the at least a portion of the inner rotor out of the rotational gap.

Despite any methods being outlined in a step-by-step sequence, the completion of acts or steps in a particular chronological order is not mandatory. Further, modification, rearrangement, combination, reordering, or the like, of acts or steps is contemplated and considered within the scope of the description and claims.

It is specifically intended that the present invention not be limited to the embodiments and illustrations contained herein, but include modified forms of those embodiments including portions of the embodiments and combinations of elements of different embodiments as come within the scope of the following claims.

I claim:

1. A method for assembling a gerotor, the method comprising:

providing a pump housing including a channel extending at least substantially therethrough and a rotor positioning cavity extending from the channel, a pump shaft having a central pump shaft axis, an outer rotor, and an inner rotor having a central inner rotor axis;

wherein the pump shaft includes at least one pump shaft notch and the inner rotor has at least one protrusion being generally complementary to the at least one pump shaft notch;

inserting the pump shaft through the channel in the pump housing and at least partially through the rotor positioning cavity;

sliding the inner rotor onto the pump shaft at an oblique angle such that the central inner rotor axis is at least partially angularly offset from the central pump shaft axis;

rotating the inner rotor such that the central inner rotor axis is substantially aligned with the central pump shaft axis to engage the pump shaft with the inner rotor;

wherein rotating the inner rotor further includes complementarily engaging a notch edge of the at least one pump shaft notch with a protrusion edge of the at least one protrusion such that the engagement substantially secures the pump shaft axially to the inner rotor with respect to the central axis; and positioning the outer rotor around the inner rotor to maintain the substantial alignment of the inner rotor with respect to at least one of the pump housing and the pump shaft.

2. The method of claim 1, wherein the pump shaft includes an insertion end portion having the at least one pump shaft notch and the inserting the pump shaft further includes inserting the insertion end portion into the pump housing to position the at least one pump shaft notch at least partially inside the rotor positioning cavity.

3. The method of claim 2, wherein sliding the inner rotor further includes sliding the inner rotor onto the insertion end portion.

4. The method of claim 3, wherein the at least one protrusion extends radially inward into an inner mating cavity with the at least one protrusion being generally complementary to the at least one pump shaft notch.

5. The method of claim 4, wherein rotating the inner rotor further includes complementarily engaging a lateral extension of the at least one protrusion with the at least one pump shaft notch in a longitudinal direction with respect to the pump shaft, such that the engagement substantially secures the pump shaft rotationally with respect to the inner rotor.

6. The method of claim 4, wherein rotating the inner rotor further includes engaging the at least one pump shaft notch and the at least one protrusion longitudinally with respect to the pump shaft, thereby substantially securing the pump shaft at least one of rotationally and axially with respect to the inner rotor.

7. The method of claim 6, wherein rotating the inner rotor further includes complementarily engaging a second notch on the pump shaft with a second protrusion extending radially inward into the inner mating cavity of the inner rotor.

8. The method of claim 7, wherein engaging the second protrusion and the second notch secures the pump shaft at least partially in an axial direction with respect to the inner rotor.

9. The method of claim 4, wherein the inner rotor has a plurality of outer gear teeth and the outer rotor has a plurality of inner gear teeth and the positioning includes meshingly engaging the outer gear teeth and the inner gear teeth; and wherein the positioning of the outer rotor with respect to the inner rotor provides for a gear cavity between the inner gear teeth and the outer gear teeth, the gear cavity comprising a plurality of intake actuating chambers on an intake side for intaking liquid into the gear cavity and a plurality of discharge actuating chambers on the discharge side for discharging liquid from the gear cavity.

10. The method of claim 1 wherein sliding the inner rotor further includes situating at least a portion of the inner rotor inside a rotational gap and wherein rotating the inner rotor further includes rotating the at least a portion of the inner rotor out of the rotational gap.

11. A gerotor assembly comprising:

a pump housing with a channel that extends at least substantially therethrough and a rotor positioning cavity that extends from the channel;

a pump shaft having a central pump shaft axis and at least one pump shaft notch at an insertion end portion, wherein the insertion end portion is inserted through the channel and at least partially into the rotor positioning cavity;

an inner rotor having a central inner rotor axis, the inner rotor inserted onto the insertion end portion of the pump shaft at an oblique angle such that the central inner rotor axis is at least partially angularly offset from the central pump shaft axis, the inner rotor having at least one protrusion extending radially inward into an inner mating cavity and the at least one protrusion being generally complementary to the at least one pump shaft notch, whereby the inner rotor is rotatable such that the central inner rotor axis is substantially aligned with the central pump shaft axis, thereby the at least one protrusion engages the at least one pump shaft notch, substantially securing the pump shaft with respect to the inner rotor;

wherein the at least one protrusion has a protrusion edge that complementarily engages a notch edge of the at least one pump shaft notch and wherein the engagement substantially secures the pump shaft axially to the inner rotor with respect to the central inner rotor axis; and an outer rotor that is engaged with the inner rotor such that the interface substantially maintains alignment of the central inner rotor axis and the central pump shaft axis, such that the pump shaft is interlocked with the inner rotor to secure the pump shaft to the inner rotor.

12. The gerotor assembly of claim 11, wherein the at least one protrusion has a lateral extension that complementarily engages the at least one pump shaft notch in a longitudinal direction with respect to the pump shaft and wherein the engagement substantially secures the pump shaft rotationally with respect to the inner rotor.

13. The gerotor assembly of claim 11, wherein the at least one protrusion complementarily engages the at least one pump shaft notch on the pump shaft in a longitudinal direction with respect to the pump shaft, thereby substantially securing the pump shaft at least one of rotationally and axially with respect to the inner rotor.

14. The gerotor assembly of claim 13, wherein the pump shaft includes an annular second notch and the first notch, and the inner rotor includes a second protrusion that extends radially inward into the inner mating cavity, the second protrusion engaging the second notch such that the pump shaft is at least partially secured axially to the inner rotor.

15. The gerotor assembly of claim 11, wherein the inner rotor has a plurality of outer gear teeth and the outer rotor has a plurality of inner gear teeth, such the outer gear teeth mesh with the inner gear teeth, and wherein the outer rotor plurality of inner gear teeth includes one more tooth than the plurality of outer gear teeth of the inner rotor.

16. The gerotor assembly of claim 15, wherein the outer gear teeth and the inner gear teeth define a gear cavity having a plurality of intake actuating chambers on a gear intake side and a plurality of discharge actuating chambers on a gear discharge side.

17. The gerotor assembly of claim 16, wherein the pump housing further comprises a housing intake portion with an intake port and an intake chamber to receive liquid into the intake actuating chambers, and a housing discharge portion wherein the discharge actuating chambers discharge the liquid through a discharge chamber and a discharge port.

18. The gerotor assembly of claim 17, wherein the pump housing is of unitary construction.

19. An internal combustion engine comprising:

a crankcase; and a gerotor assembly connected at least indirectly to the crankcase, the gerotor assembly comprising:

a pump housing that is connected to, or at least partially integrally formed with, the crankcase, the pump housing having a channel that extends at least substantially therethrough and a rotor positioning cavity that extends from the channel;

a pump shaft having a central pump shaft axis and at least one pump shaft notch, wherein the pump shaft is insertable through the channel and at least partially into the rotor positioning cavity;

an inner rotor having a central inner rotor axis and at least one protrusion, where the inner rotor is insertable onto the pump shaft at an oblique angle such that, during insertion, the central inner rotor axis is at least partially angularly offset from the central pump shaft axis and, once inserted onto the pump shaft, the inner rotor is positioned such that the central inner rotor axis is substantially aligned with the central pump shaft axis and the pump shaft is engaged to the inner rotor;

wherein the at least one protrusion complementarily engages the at least one pump shaft notch on the pump shaft in a longitudinal direction with respect to the pump shaft, thereby substantially securing the pump shaft axially with respect to the inner rotor; and an outer rotor where the outer rotor is engaged with the inner rotor such that the interface maintains substantial alignment of the inner rotor with respect to at least one of the pump housing and the pump shaft.

20. The internal combustion engine of claim 19, wherein the pump shaft further includes an insertion end portion having the at least one pump shaft notch and the at least one protrusion of the inner rotor extends radially inward into an inner mating cavity with the at least one protrusion being generally complementary to the at least one pump shaft notch, whereby the at least one protrusion and the at least one pump shaft notch engage once the inner rotor is positioned by rotating the inner rotor.

21. The internal combustion engine of claim 20, wherein the at least one protrusion complementarily engages the at least one pump shaft notch on the pump shaft in a longitudinal direction with respect to the pump shaft, thereby substantially securing the pump shaft rotationally.

22. The internal combustion engine of claim 21, wherein the pump shaft includes an annular second notch and the first notch, and the inner rotor includes a second protrusion that extends radially inward into the inner mating cavity, the second protrusion engaging the second notch such the pump shaft is at least partially secured axially to the inner rotor.

* * * * *